US007059072B2

(12) United States Patent
Archuleta, Jr. et al.

(10) Patent No.: US 7,059,072 B2
(45) Date of Patent: Jun. 13, 2006

(54) SUBSOILING EXCAVATOR BUCKET

(75) Inventors: James G. Archuleta, Jr., Roseburg, OR (US); Michael W. Karr, Idleyld Park, OR (US)

(73) Assignee: The United States of America as represented by the Secretary of Agriculture, Washington, DC (US)

( * ) Notice: Subject to any disclaimer, the term of this patent is extended or adjusted under 35 U.S.C. 154(b) by 313 days.

(21) Appl. No.: 10/781,487

(22) Filed: Feb. 18, 2004

(65) Prior Publication Data

US 2004/0187364 A1 Sep. 30, 2004

Related U.S. Application Data

(60) Provisional application No. 60/448,776, filed on Feb. 20, 2003.

(51) Int. Cl.
*E02F 3/32* (2006.01)

(52) U.S. Cl. ..... 37/468; 37/404; 37/410; 299/26; 299/67

(58) Field of Classification Search ..... 37/403–410, 37/468; 299/26, 67
See application file for complete search history.

(56) References Cited

U.S. PATENT DOCUMENTS

| | | | | | |
|---|---|---|---|---|---|
| 3,685,404 | A | * | 8/1972 | Rich et al. | 299/24 |
| 3,724,899 | A | * | 4/1973 | Clark | 299/26 |
| 4,041,624 | A | * | 8/1977 | Fryrear | 37/404 |
| 4,845,867 | A | | 7/1989 | Albrecht | |
| 5,456,028 | A | | 10/1995 | Larson | |

* cited by examiner

*Primary Examiner*—Christopher J. Novosad
(74) *Attorney, Agent, or Firm*—John D. Fado; Chris P. Ribando; Leslie Shaw

(57) ABSTRACT

An excavator bucket adapted to receive subsoiler shanks and an optional coulter blade enables multiple treatment of compacted soil. In a preferred embodiment, the shanks depend downward below the bucket and curve forward toward the bottom of the bucket. The shanks allow a single implement to be used for both excavating and subsoiling, and also for contouring sloping terrain. One application for such an implement is for decommissioning forest roads without the need for multiple pieces of heavy equipment or for multiple entries into the treatment area.

6 Claims, 6 Drawing Sheets

SUBSOILING EXCAVATOR BUCKET

CROSS-REFERENCE TO RELATED APPLICATION

This invention is related to provisional application 60/448,776, filed Feb. 20, 2003 and also to commonly-owned application assignable to the United States of America, as Represented by the Secretary of Agriculture, having the title "Subsoiling Grapple Rake" and Ser. No. 10/781,612 and naming James Geronimo Archuleta, Jr. and Michael William Karr as inventors, both herein incorporated by reference.

BACKGROUND OF THE INVENTION

1. Field of the Invention

This invention relates to a multi-purpose implement for conducting dissimilar forest and soil management activities, including excavation and subsoiling (especially as related to soil productivity and restoration). The invention finds particular application in the decommissioning of forest roads, new temporary roads, skid trails and landings logging roads and in the growth and vigor of natural and planted trees and forage shrubs expected to grow on decommissioned roads. New impacts occur when equipment is brought into an area on a short-term basis, such as for fire-line construction, and the remedial treatment takes place shortly thereafter. The expression, "legacy compaction" as used herein refers to compaction from previous activities, particularly those involving operating heavy equipment on the soil surface. Examples of situations that lead to legacy compaction include repeated travel on road fill skill trails, dozer pile slash treatment and soil deposition from erosion that occurs over a work site at the toe of a hill. Whereas compaction from new impacts typically resides 4–18" below the soil surface, legacy compaction may be deeper, and also may be accompanied by hardpan formation.

2. Description of the Prior Art

Following timber harvesting, restoration activities include obliteration of forest roads, new temporary roads, skid trails and landings and reduction of timber harvest legacy decompaction. Compaction has been associated with reduced mycorrhizal abundance and diversity in certain tree species, and also with ultimate growth rates and overall alteration of vegetation type. Restorative activities have conventionally required at least two pieces of heavy equipment and two entries. An excavator is used for the removal of culverts, creating waterbars, and recontouring of the road in sloped landscapes (excavation pullback of the fill slope). In a separate operation, subsoiling is done with a dozer pulling an agricultural subsoiling implement or dozer-mounted ripper system. This approach to subsoiling reduces compaction, but does not allow return of organic matter to the soil. Also, mats of organic matter tend to accumulate under the agricultural implement, resulting in a loss of organic matter from the soil resource. Moreover, the narrowness of forest system roads restricts the dozer-driven subsoiler movement to straight-line travel down the road being decommissioned. This may result in subsurface "piping", leading to failure of sloping surfaces.

Attempts have been made to do the combined work with excavators using standard buckets, log tongs, and grapple rakes. Though decompaction is accomplished and organic matter returned to the surface of treated soil, the resultant soil profile becomes mixed rather than lifted. When re-contouring the road prism, subsoiling the ditch line is often left undone, primarily as the result of short-sighted economics. Unfortunately, neglect of subsoiling the compacted ditchline can lead to subsurface routing and transport of water moving across slope, rather than down slope, or to subsurface water impounding.

Buckets having attached ripper tools for multi-functional earth-moving capabilities have been disclosed in the patent literature. For example, Larson (U.S. Pat. No. 5,456,028) shows a backhoe bucket having a single ripper attached to the same coupling element that secures the bucket to the end of a hydraulically powered boom. The result is concentration of the force provided by the boom to the ripper tip. Larson depicts various embodiments for coupling the ripper to the boom, but none are amenable to use with a "quick change" connector (tool coupler). Moreover, the pivotal mount of the ripper to the back of the bucket is susceptible to eventual stress failure. In Pub. No. US 2003/0167661, Larson discloses an improvement in which the ripper is secured to a tool coupler to permit its use with a wide variety of interchangeable excavation tools.

Pratt (U.S. Pat. No. 6,490,815) shows an excavating bucket having a single ripping tooth or a pair of ripping teeth projecting rearwardly from the rear wall of the bucket. By virtue of this design, the motion for functional operation of the ripper is opposite that of the bucket. In making a sweeping motion, the operator is able to alternatively break up hard material and scoop it up for removal.

SUMMARY OF THE INVENTION

We have now devised an excavator bucket equipped with sidewall-supported subsoiler shanks that enter the soil and loosen the compacted soil profile as the excavator bucket is used to remove soil. When the bucket returns to excavate the primed area, there is less torque needed from the equipment to remove the loosened soil. In a preferred embodiment of the invention, each subsoiler shank is secured to an extension of bucket sidewall that functions as a coulter blade for cutting through organic matter.

It is an object of this invention to provide a durable, multi-purpose implement and method for excavation and subsoiling, and optionally for cutting through organic materials.

It is also an object of the invention to provide a multi-purpose implement and method that can simultaneously conduct the activities of excavation and subsoiling without additional labor and equipment cost, and thereby reduce the cost of restoration.

It is also an object of the invention to provide an approach for decommissioning forest system roads without the need for two different pieces of heavy equipment.

Another object of the invention is to provide a single implement for subsoiling and contouring sloping terrain.

Other objects and advantages of this invention will become readily apparent from the ensuing description.

DETAILED DESCRIPTION

It is understood that an excavating bucket in operation can assume a large variety of positions relative to a given point of reference, such as the ground or the horizon. For purposes of the ensuing discussion, the open end of the bucket will be considered the front, and the opposite end of the bucket the rear. The bucket attaches to the boom of the excavator implement at its top, and the opposing side of the bucket is considered to be the bottom. When the bucket is used in a conventional digging operation, it is usually the leading edge at the bottom of the bucket that is the first to contact the ground.

Figure 1:
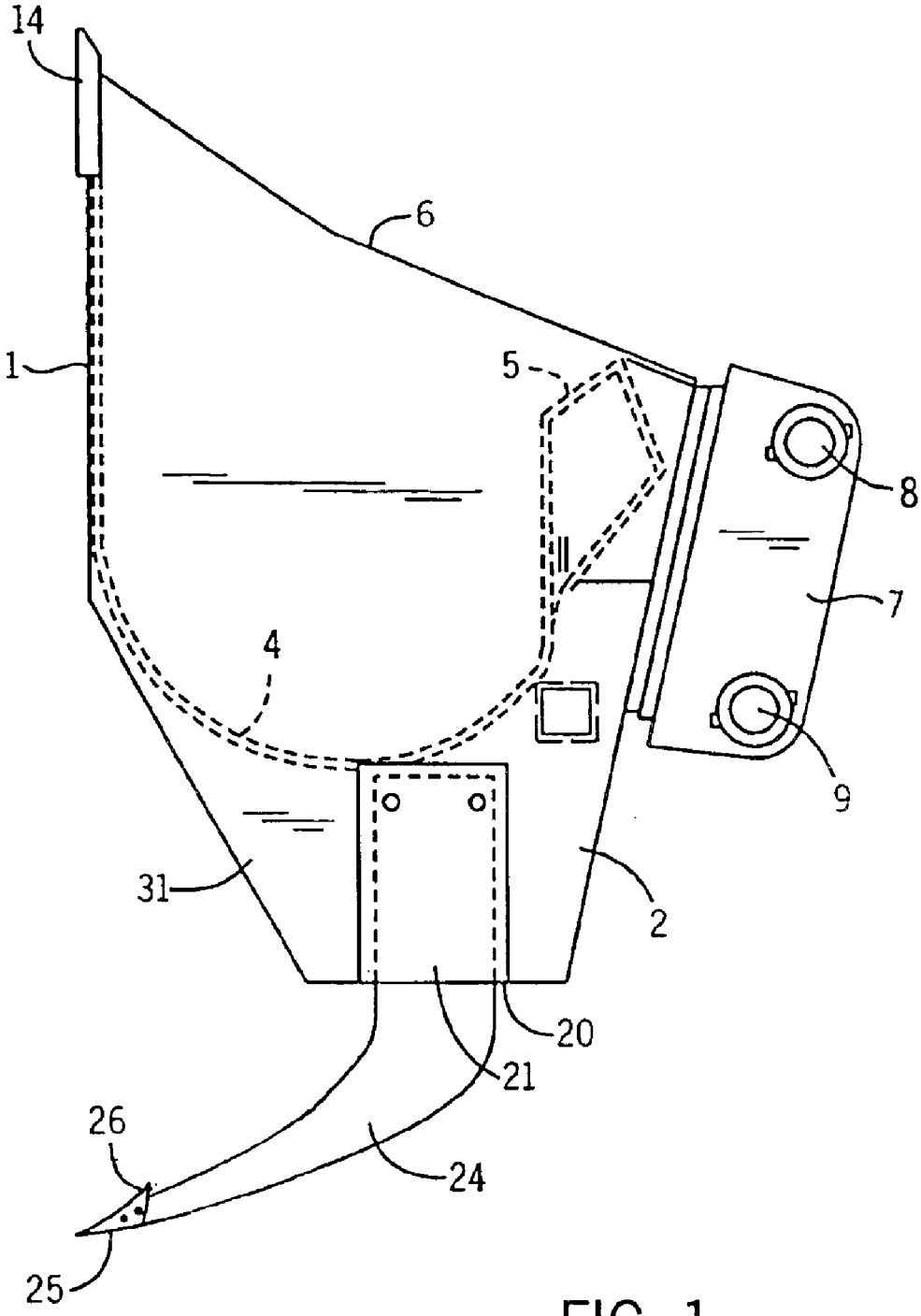
FIG. 1 is a side elevation view of the multi-purpose bucket of the invention with the subsoiling shanks attached.
Figure 3:
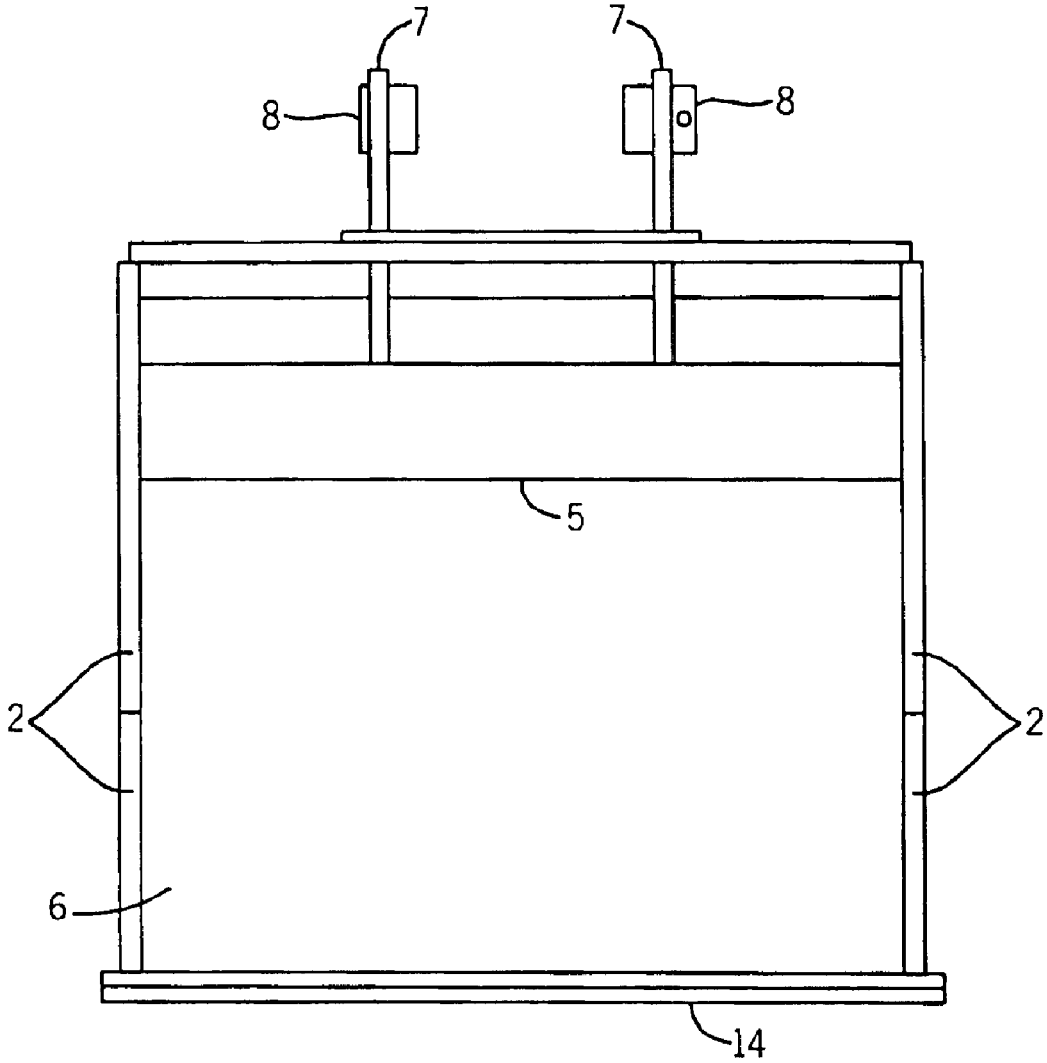
FIG. 3 is a front view of the multi-purpose bucket of the invention without the bucket teeth attached.
Figure 4:
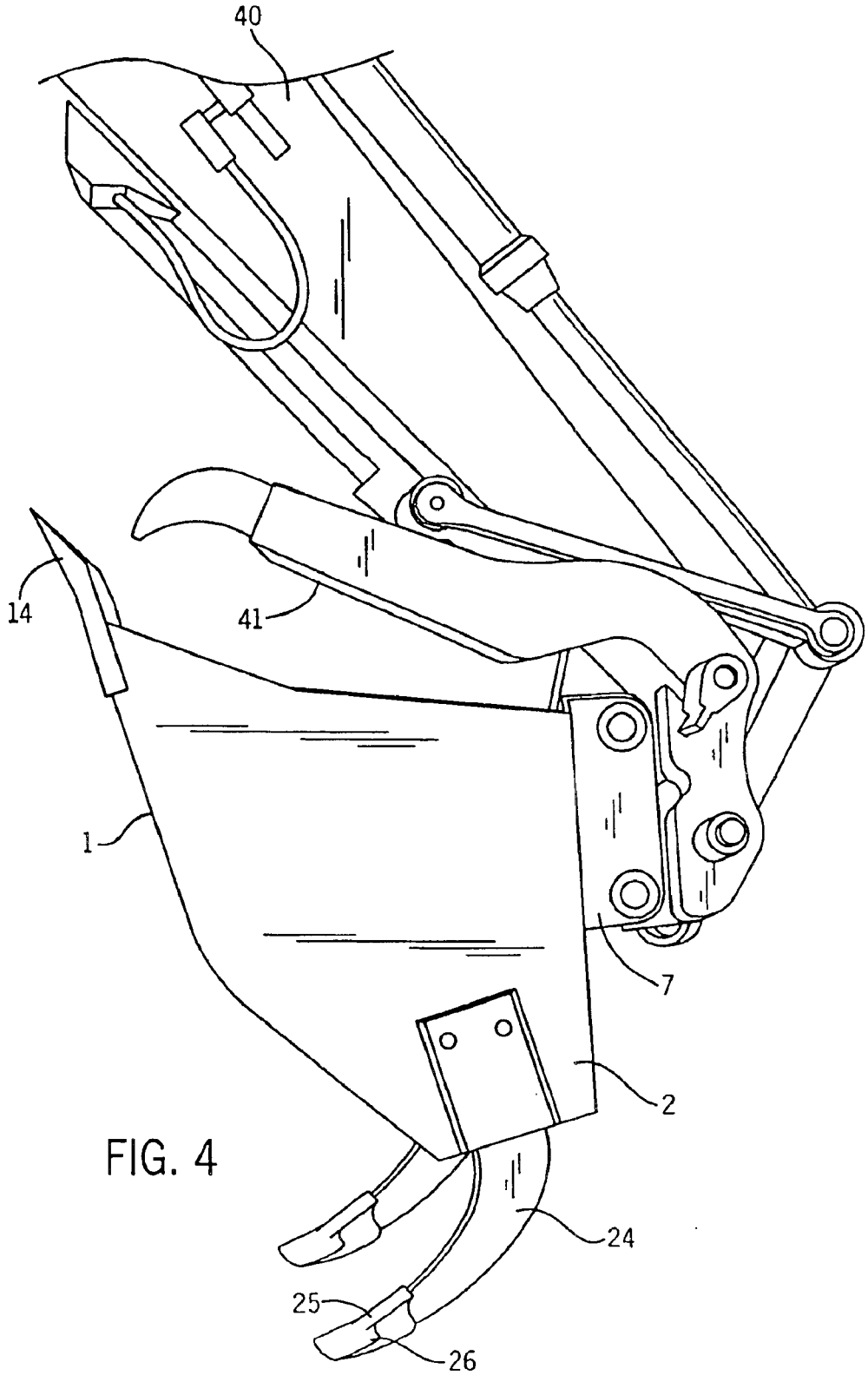
FIG. 4 is a perspective view of the multi-purpose bucket/subsoiler of the invention attached to an excavator boom.

As best illustrated in FIGS. 1 and 4, bucket 1 comprises opposing side walls 2 joined by a generally concave pan 4. The opposing side walls will typically be parallel or substantially parallel to one another, but may also be tapered toward the front, rear, top or bottom of the bucket. The pan 4 has a leading edge 14 that may be the terminal edge of the pan itself, or alternatively may comprise a separate piece of reinforcing material welded to the pan or otherwise securely attached. The leading edge 14 may also be fitted with teeth (not shown). The pan 4 also comprises a trailing edge 5 at the opposite extremity of the pan from the leading edge 14. Referring to FIGS. 1 and 3, the trailing edge 5 is near mounting members 7, each having a front aperture (bearing) 8 and a rear aperture 9 (bearing) for mounting of the bucket to the appropriate linkages of an articulated excavator boom 40 shown in FIG. 4. The leading and trailing edges of pan 4, as well as the front edges of side walls 2 that are in proximity to the leading and trailing edges, collectively form bucket opening 6 (FIGS. 1 and 3).

Figure 2:
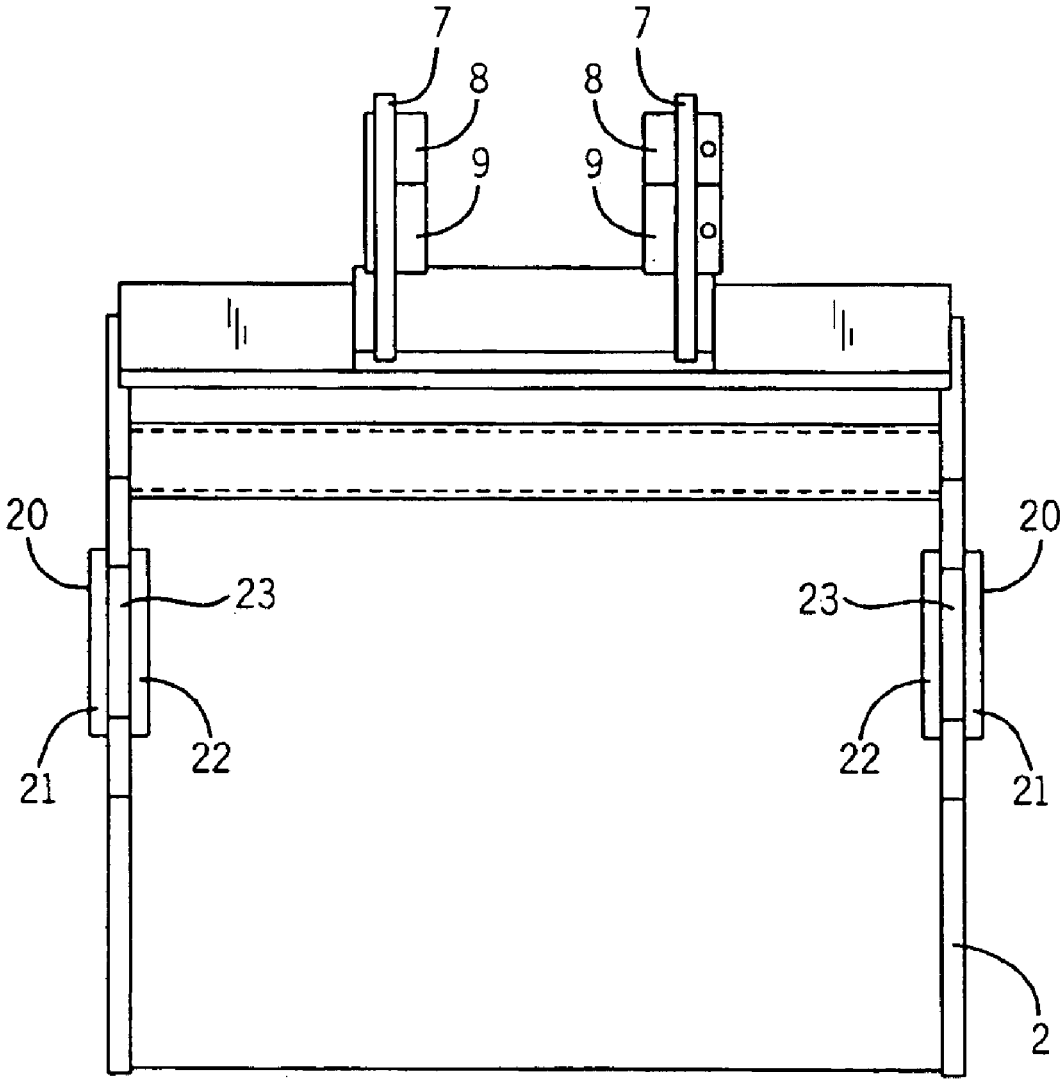
FIG. 2 is a back view of the multi-purpose bucket of the invention without the subsoiling shanks attached.

Each of the side walls 2 comprises a shank socket 20 (FIGS. 1 and 2). The shank socket may be formed by an exterior plate 21 and an interior plate 22 enclosing cutout 23 in side wall 2. The open end of socket 20 and bucket opening 6 are oriented in generally opposite directions from one another. Each socket 20 is adapted to receive and secure the proximal end of subsoiling shank 24. The distal end of each shank is a substantially pointed earth-working tool, such as a hardened, abrasion-resistant ripper point 25 having one or more wing tips 26, the upper working surfaces of which lie in a plane substantially perpendicular to the plane of penetration of each subsoiling shank as visible in FIG. 4. The shank is inserted into the open end of the socket and will typically be held in place in the socket by means of suitable fasteners that permit easy removal and replacement of the shank. In the preferred embodiment, the shank length is sufficient to subsoil at a depth of approximately 24–30", and the shanks are positioned on the side walls of the bucket so that the distal ends of the ripper points 25 extend approximately 1–3" beyond the plane of the bucket bottom. Also, the upper working surface of the ripper points 25 and the wing tips 26 are preferably oriented at an angle of approximately 70° (±10°) relative to the plane in which the bucket bottom lies.

The shanks for subsoiling can be standard commercial parts (e.g. John Deere® part number A24206) or similar fabricated steel shanks, typically having a curvilinear profile. The shank length and degree of curvature will determine the maximum depth of subsoiling. With a given set of shanks, the equipment operator can control the depth of penetration into the soil, and thus the actual depth of de-compaction. Depending on the depth of compaction and the subsurface strata (e.g. rock), the maximum operating depth can be controlled by means of both the shank length and operator control. It is also envisioned that the subsoiling depth can be varied by providing multiple mount positions within the socket. The use of ripper points on the subsoiling shanks can be standard commercial parts, such as John Deere® 5" or 7" sweeps. The size and angle/slope of wing tips can vary depending upon desired lateral fracture of compacted soil being treated.

In a preferred embodiment of the invention, the bucket side walls 2 each comprise an extension exterior of pan 4 (FIG. 1). This extension tapers from the pan toward the open end of the socket 20 so as to form a sharpened, coulter blade 31 above and forward of the leading edge of the subsoiler (when the subsoiler is oriented in the subsoiling mode) as illustrated in FIG. 1. The coulter blade leads the subsoiling shank through the soil, cutting grass mats and organic matter, surface or subsurface roots, downed tree branches, etc. Positioning of the coulter blades between the bottom of the bucket and the shanks also serves to extend the maximum effective subsoiling depth. In one embodiment of the invention, the implement or implement coupling is equipped with a vertical orientation device (not shown) to provide feedback to the operator in regard to the attitude of the subsoiling shanks with respect to the soil surface. The orientation device may consist of a simple visual indicator, or may comprise an electrical and/or electronic device, such as a mercury switch and logic circuit with visual, auditory or other sensory signal as known in the art. The articulated excavator boom 40 shown in FIG. 4 may also be equipped with a thumb 41 such as that described by Pisco, U.S. Pat. No. 5,813,822, herein incorporated by reference.

The implement described above has two modes of operation, excavation and subsoiling. By pivoting the implement at the end of the excavator boom, the operator can alternate from one mode to the other. Thus, while one mode of the implement is oriented in an operable position, the other is in an "idle" position. During subsoiling, the boom is extended away from the excavator, the bucket is pivoted to the closed position (open end upward), thereby employing the distal ends of the subsoiling shanks into the proper position for movement through the soil: in a plane beneath, and generally parallel to, the soil surface. The implement is lowered toward the ground until the shanks penetrate the soil to the desired depth. As the boom draws the implement toward the excavator, the point-forward subsoiler shank curvature tends to draw the shanks down into the soil so that the proximal ends of the shanks are substantially perpendicular to the ground and distal ends are substantially parallel to the ground. As the shanks slice through the soil, the earth-working ends move through the soil along a path that is in a plane beneath, and generally parallel to, the soil surface. The desired effect of the subsoiling operation is obtained when the path of the earth-working ends is below the level of hardpan or other soil compaction. Thus, the depth of the plane should be sufficient to allow vegetation and tree roots adequate depth of soil decompaction to thrive. During movement of the subsoiler shanks through a zone of hardpan or soil compaction, the curvilinear shanks and wing tips impart an uplifting of the entire column of soil above the subsoiling shank and cause a fracturing of the hardpan and other soil strata. The lifting of the soil column takes advantage of the plate-like compacted soil structure to extend the lateral fracture to approximately 7–12 inches to either side (depending upon soil type and wing tip selection) from the centerline of the subsoiling shanks. The result is both a vertical and lateral decrease in the bulk density (or loosening) of the soil profile.

When a sizeable object such as a large root or tree branch is encountered during the subsoiling operation, the equipment operator obtains optimal functionality of the coulter blade by tilting the bucket opening toward the ground, thereby pinning the object against the soil on the opposite side of the object from the coulter blade. This has the effect of imparting a guillotine action and enhancing the downward, shearing force on the object. The paired coulter blades and shanks cooperate with one another and serve to stabilize longer pieces of debris that exceed the breadth of the bucket while being subjected to shearing forces. Shearing the debris prevents it from being pulled through the soil or across the soil surface by the subsoiling shanks, thereby helping to preserve the integrity of the topsoil or other soil stratum. Prior to lifting the subsoilers from the soil, it is desirable to retreat the boom a short distance along the previously subsoiled path so that the wing tips are raised through soil that is already fractured. This avoids catching the tips on rocks and other firmly entrenched objects that would tend to result in breakage of the tips and helps prevent soil displacement and mixing.

If it is necessary to excavate the subsoiled area, then the open end of the bucket is pivoted downward with the subsoiler shanks positioned above grade. As the bucket is drawn into the soil, filled and pivoted back into an upright orientation, the attitude of the boom can be controlled so that the trailing subsoilers will re-enter the soil, thereby loosening it in advance of the next pass of the bucket. In this fashion, the subsoiling and excavation operations are sequentially accomplished in a single sweep of the boom. Both the subsoiling and excavation can be conducted through the normal range of operation of the excavator boom. In areas of clayey soils and rock strata, the operations of subsoiling and excavation would typically be conducted independently of one another.

The bucket/subsoiler of this invention may be used with any make of excavator, optimally one that is greater than 43,000 pounds and up to about 50,000 pounds gross vehicle weight rating (GVWR) to allow for adequate hydraulic power and excavator ability needed to obtain the full functional capacity.

The application of this implement can vary from basic excavation needs without subsoiling to full obliteration of a road. Other potential uses are to rehabilitate forested environments, skid trail and temporary logging road decommissioning, treatment of small and large scale acreage legacy compaction associated with prior timber harvest and land management activities, wildland fire suppression efforts or suppression rehabilitation, BAER work (Burned Area Emergency Rehabilitation); non-forested environments such as wetland reclamation, urban rehabilitation and creation (roads to trails and roads to parks) of green spaces and contractor needs for utility trenching and building foundation, road and street construction.

Figure 5B:
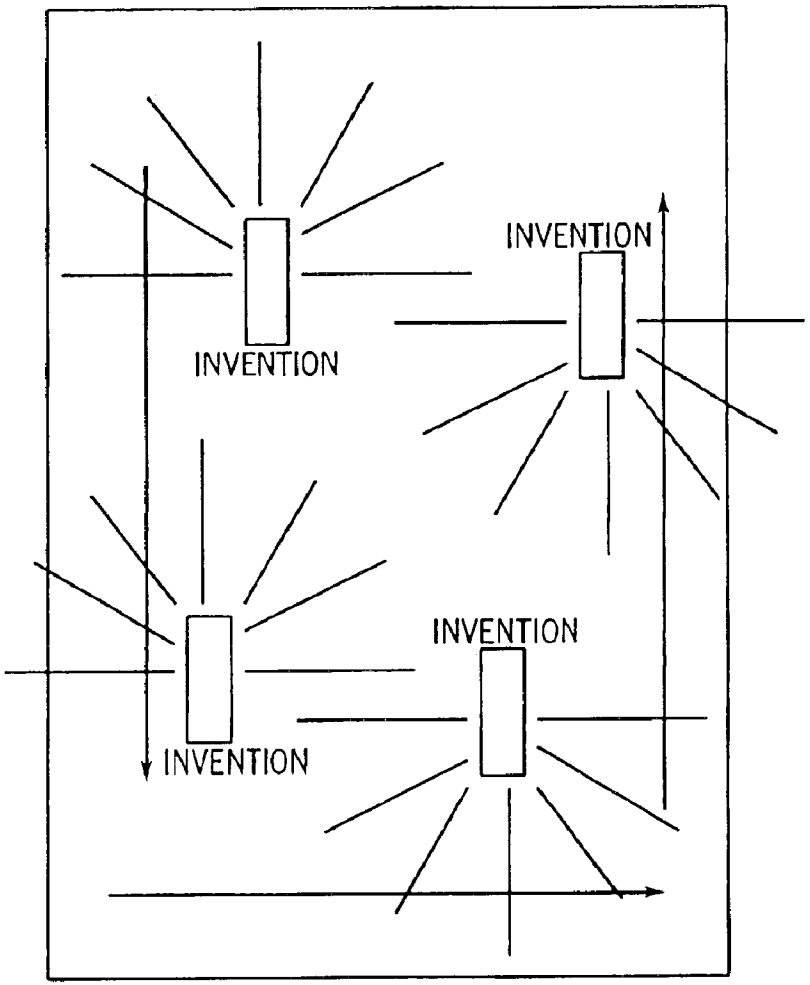
FIG. 5B is a schematic representation of the subsoiling pattern created by the combination excavator bucket and subsoiler of the invention moving though a unit being restored.
Figure 5A:
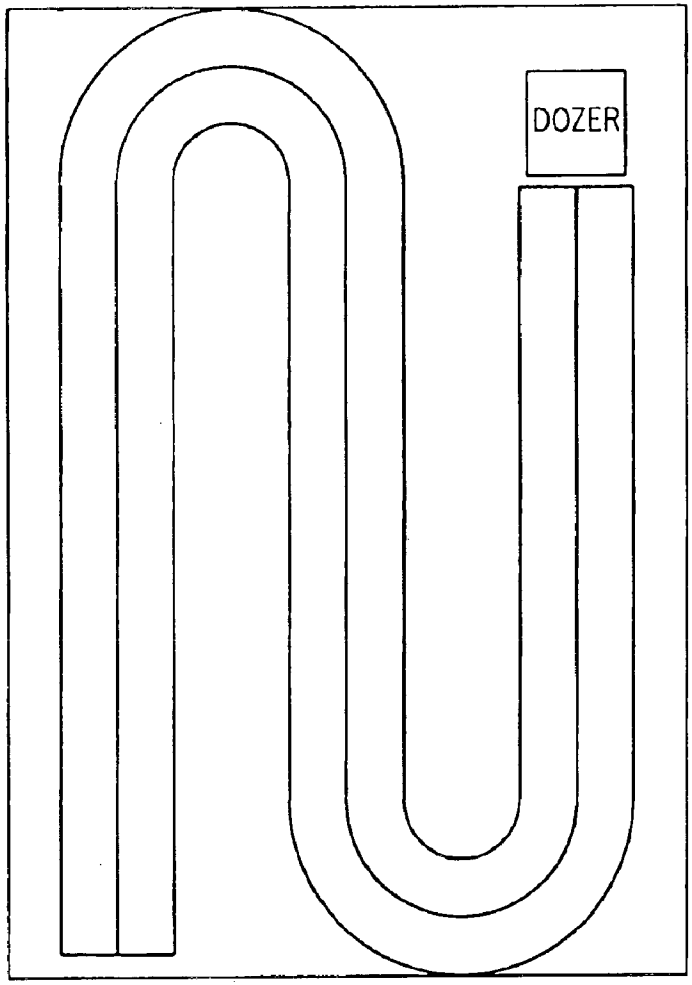
FIG. 5A is a schematic representation of the subsoiling pattern created by a subsoiling implement attached to a dozer moving through a unit being restored.
Figure 5C:
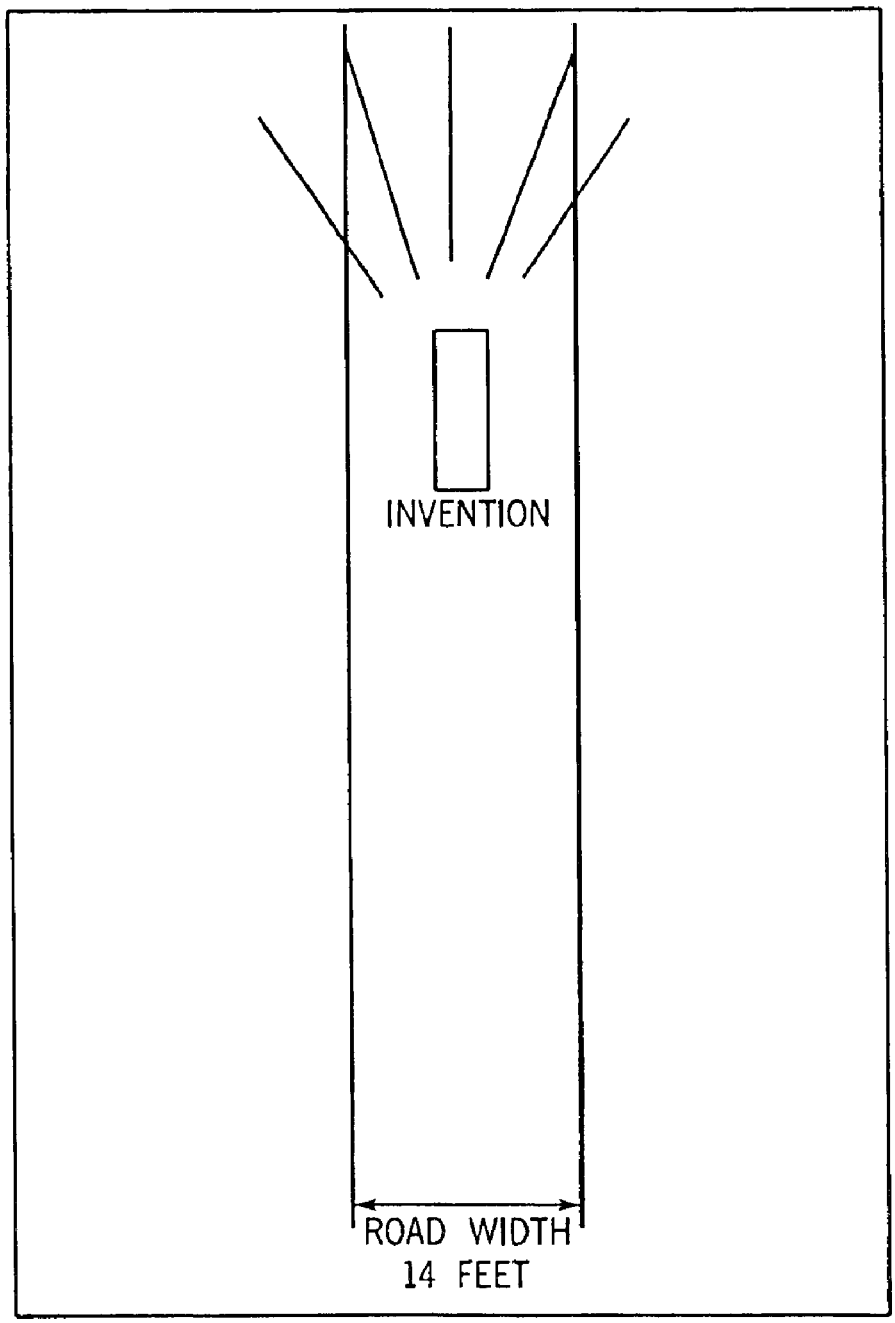
FIG. 5C is a schematic representation of the pattern created by the combination excavator bucket and subsoiler of the invention during road obliteration and decompaction.

The subsoiler bucket-equipped excavator would be the last machine to leave a project area, preventing the creation of new compaction or leaving legacy impacts untreated. By erasing the footprint of all previous and current equipment impacts the inevitable lag time between management activity and restoration is shortened or eliminated. In FIG. 5B, the subsoiling pattern in a broad area produced by the bucket/subsoiler of the invention as it moves through the area (as shown by arrows) is depicted in comparison to that produced by a dozer (FIG. 5A). The subsoiling pattern for a road being decommissioned by the invention is illustrated in FIG. 5C. After the area is subsoiled, oversized organic material (logs, tree stumps, small trees, brush or boulders) is returned onto the restored landscape. Typically, planting is scheduled for the following year to allow for subsidence of treated soil.

All references disclosed herein or relied upon in whole or in part in the description of the invention are incorporated by reference.

We claim:

1. An earth-working bucket adapted for conversion to a combination excavator and subsoiler implement and further adapted for pivotal attachment to an excavating machine, comprising:

(a) opposing side walls joined by a generally concave pan, said pan having a leading edge at the bottom of the bucket and a trailing edge at the top of the bucket, and each of said side walls having an edge in proximity to said leading pan edge and trailing pan edge, wherein together said leading pan edge, trailing pan edge and said side wall edges define a bucket opening, and further wherein each of said opposing side walls comprises an extension that is exterior to said pan and is tapered toward said open end of the socket, said extension comprising a coulter blade having a smooth shearing edge;

(b) pivotal attachment means secured to the top of said bucket and;

(c) a shank socket incorporated into each of said opposing side walls and having an open end, said socket adapted to receive and secure a proximal end of a subsoiling shank having a substantially pointed, earth-working distal end, wherein said open end of said socket and said bucket opening are oriented in generally opposite directions from one another.

2. The earth-working bucket of claim 1, wherein said shank socket is adapted to receive at least one removable fastener for securing said subsoiling shank within said socket.

3. The earth-working bucket of claim 1, and further comprising a subsoiling shank secured within said shank socket.

4. The earth-working bucket of claim 3, wherein said subsoiling shank lies substantially in a first plane and comprises at least one wing lying in a second plane that is substantially perpendicular to said first plane.

5. The earth-working bucket of claim 4, wherein the bottom of the bucket lies in a third plane and the distal end of said subsoiling shank extends from the shank socket to beyond said third plane.

6. The earth-working bucket of claim 3, wherein said subsoiling shank has a curvilinear profile.

* * * * *